United States Patent [19]

Burczynski

[11] Patent Number: 4,836,110

[45] Date of Patent: Jun. 6, 1989

[54] BULLET HAVING SECTIONS SEPARABLE UPON IMPACT AND METHOD OF FABRICATION

[76] Inventor: Thomas J. Burczynski, P.O. Box 248, 107 Main St., Odessa, N.Y. 14869

[21] Appl. No.: 140,587

[22] Filed: Jan. 4, 1988

[51] Int. Cl.[4] ..... F42B 11/10

[52] U.S. Cl. ..... 102/508; 102/501; 102/509

[58] Field of Search ..... 102/501, 506–509

[56] References Cited

U.S. PATENT DOCUMENTS

| | | | |
|---|---|---|---|
| 90,732 | 6/1869 | Curtis | 102/506 |
| 219,840 | 9/1879 | Winchester | 102/506 |
| 1,114,356 | 10/1914 | Hoagland | 102/507 |
| 1,135,357 | 4/1915 | Clyne | 102/508 |
| 1,833,645 | 11/1931 | Hartz | 102/508 |
| 2,045,964 | 6/1936 | Rinkel | 102/509 |
| 2,661,694 | 12/1953 | Allen et al. | 102/508 |
| 3,097,603 | 7/1963 | Harper | 102/506 |
| 3,138,102 | 6/1964 | Meyer et al. | 102/509 |
| 3,143,966 | 8/1964 | Burns et al. | 102/507 |
| 3,157,137 | 11/1964 | Burns | 102/509 |
| 3,991,684 | 11/1976 | Pritchard | 102/510 |
| 4,044,685 | 8/1977 | Aucin | 102/508 |
| 4,550,662 | 11/1985 | Burczynski | 102/509 |
| 4,655,140 | 4/1987 | Schimeker | 102/508 |

FOREIGN PATENT DOCUMENTS

| | | |
|---|---|---|
| 4426 | of 1899 | United Kingdom . |
| 14717 | of 1899 | United Kingdom . |

*Primary Examiner*—David H. Brown

*Attorney, Agent, or Firm*—Charles S. McGuire

[57] ABSTRACT

A rifle or handgun bullet having a base and a leading end of ogival shape extending for a portion of its length is divided into a plurality of sections by parting lines extending radially from the central axis and terminating a short distance from the outer wall, whereby the sections are joined by relatively thin webs at their outer edges. The parting lines extend longitudinally from the leading end through at least the ogival portion to as much as 90% of the length of the bullet. Upon impact with a lubricious target the sections separate from one another and from the base, i.e., the portion into which the parting lines do not extend. The bullet is fabricated in a two-stage operation, first forcing a punch longitudinally into a cylindrical slug of malleable metal contained within a die, and then compressing the slug radially inwardly to force essentially all air from the spaces formed by the punch, thereby and forming the ogival leading end.

10 Claims, 3 Drawing Sheets

BULLET HAVING SECTIONS SEPARABLE UPON IMPACT AND METHOD OF FABRICATION

BACKGROUND OF THE INVENTION

The present invention relates to novel bullet constructions, and more specifically to a bullet divided by parting lines into a plurality of sections which separate upon impact with and entry into a target.

The prior art contains numerous examples of bullets which are designed to spread or expand upon impact. Such bullets include those known as mushrooming bullets, normally having a cavity or hollow area in the tip. Some bullets of this type are jacketed, such as those of U.S. Pat. Nos. 1,715,788 and 3,157,137, while other, such as that disclosed in U.S. Pat. No. 4,044,685, are jacketless. Further examples of expanding bullets having variously configured cavities in the tip or nose to provide expansion upon impact are found in U.S. Pat. Nos. 3,881,421 and 4,550,662 of the present inventor. Early examples of such bullets are found in U.K. Complete Specification No. 4,426 and U.K. Provisional Specification No. 14,717, both dating from 1899.

Mushrooming and other expanding bullets are intended to provide improved "stopping action," as compared to solid, non-expanding bullets. Although the bullet designs of the aforementioned patents exhibit various types of expanding action, they are intended to remain in monoblock form after impact with the target; that is, the bullet material does not separate into two or more individual pieces. The sole exception among the previously mentioned patents is one form of the bullet disclosed in Rousseau U.S. Pat. No. 1,715,788 which may, "when fired at high velocity and at close range into a soft target," disrupt and separate into two parts due to pressures developed in the central cavity extending axially into the nose of the bullet. The separation into two parts is also facilitated by "a weakened section extending circumferentially of the jacket at the point where the greatest expansion takes place." The two separated pieces, comprising front and rear sections of the bullet, apparently remain in axial alignment after separation.

It is a principal object of the present invention to provide a bullet having highly improved stopping power upon impact with a living target.

A further object is to provide a novel and improved bullet having high stability during flight, thus being capable of high accuracy, while at the same time having greater stopping power than comparable bullets of the hollow-nosed type.

Another object is to provide a bullet which is initially of monoblock form, and remains so during flight, but which separates into a plurality of individual parts or fragments upon impact with a fluidic target, thereby imparting greater damage to a living target.

Still another object is to provide a bullet which penetrates dry targets and remains in unitary or monoblock form, but which splits apart into a plurality of separate segments upon impact with a fluidic or lubricious target.

A still further object is to provide a bullet which, upon impact with a fluidic target, separates into a plurality of individual pieces which travel radially outwardly from the axis of impact within the target, thus providing superior "stopping" action.

Other objects will in part be obvious and will in part appear hereinafter.

SUMMARY OF THE INVENTION

In accordance with the foregoing objects, the invention contemplates a bullet having the external configuration of a conventional, solid bullet, with no internal cavities, with a tapered or ogival nose. The bullet is formed from an initially cylindrical section of lead, lead-alloy, or other such malleable metal, which is penetrated by a punch forced axially into the nose end for a portion (e.g., up to $\frac{7}{8}$) of the total length. The punch divides the cylindrical section from the center outwardly along three or more radial gaps or spaces which stop short of the outer periphery. That is, the material is divided into a plurality of axially extending, curved portions which remain joined along adjacent outer edges by relatively thin webs, a few thousandths of an inch in thickness.

The cylinder section of metal thus divided is then compressed radially inwardly, in a further forming operation, forcing the separated sections into tight engagement thereby forming axially extending, circumferentially adjoining sections, with opposing faces in tight engagement along radial parting lines. A further compression operation forms a tapered, ogival nose portion extending from one end for a portion of the axial length of the finished bullet. Conventional jacketing of the bullet may be added, or not, as desired. The webs joining the axially extending wedge-shaped sections at their outer peripheries are thick enough to prevent separation thereof during flight, but thin enough to ensure separation into individual pieces upon impact with a fluidic target. Preferred maximum and minimum radial thicknesses of the webs are 0.060" and 0.001", respectively.

DETAILED DESCRIPTION

Figure 1:
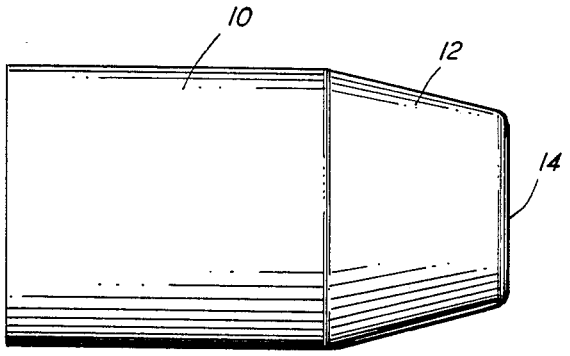
FIG. 1 is a side elevational view of the bullet of the present invention.

A preferred form of the bullet of the invention is shown in side elevation in FIG. 1, comprising a cylindrical base portion 10 and a tapered forward, a nose portion 12 having a flat or blunt forward end 14. Thus, the bullet has an entirely conventional appearance from the side, and may be inserted and crimped in the usual manner into a cartridge case (not shown) containing a powder charge and a primer. It will be understood, however, that the present invention is concerned only with the bullet itself, and the method of fabrication thereof. Furthermore, as pointed out hereinafter, the bullet may be partly or fully encased in a metal jacket, but the invention is entirely independent of whether or not the bullet is jacketed.

Figure 2:
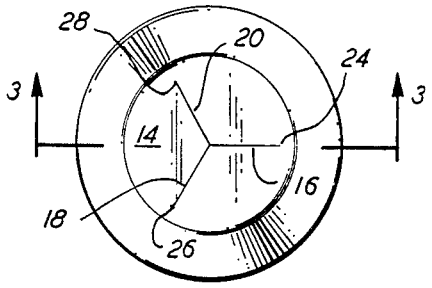
FIG. 2 is an end view from the forward or nose end of the bullet.
Figure 3:
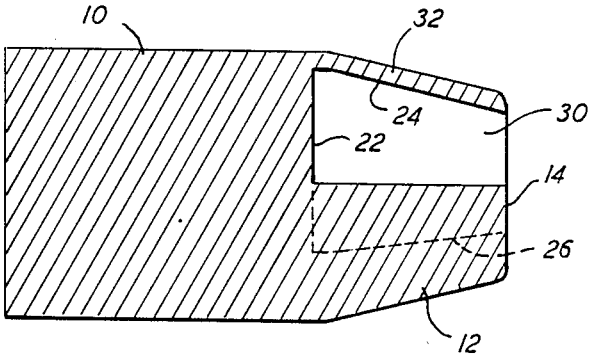
FIG. 3 is a sectional view taken on the line 3—3 of FIG. 2.

In the end view of FIG. 2, the bullet is seen to differ from conventional bullets of similar configuration by including three slits or parting lines 16, 18 and 20, arranged at substantially equal, 120° angles, on blunt end 14. In the sectional view of FIG. 3, the parting lines are seen to extend from end 14, through nose portion 12, and terminate within base portion 10. As explained later in more detail, the bullet may include three or more parting lines, all of which extend from the flat, forward end into the body of the bullet, parallel with its axis, and terminate within the base portion in a plane perpendicular to the axis. This plane is indicated in FIG. 3 by reference numeral 22 and, in this embodiment, is a very short distance from the juncture of base and nose portions 10 and 12, respectively. However, plane 22 may be spaced up to $\frac{7}{8}$ of the axial length of the bullet from the forward end thereof.

As is also evident from FIGS. 2 and 3, parting lines 16, 18 and 20 extend from the central, longitudinal axis of the bullet, radially outwardly and terminate within the body of the bullet. That is, in no instance does any parting line extend entirely through the body of the bullet, either axially or radially. The outer terminations of parting lines 16, 18 and 20 are indicated in FIG. 2 by reference numerals 24, 26 and 28, respectively. Terminations 24 and 26 of parting lines 16 and 18, respectively, are also seen in FIG. 3. Although the adjacent faces on each side of the parting lines are in intimate contact, they are not joined or affixed to one another in any way. One of the faces on opposite sides of parting line 18, through which the section is taken, is seen in FIG. 3 and denoted by reference number 30.

The portion of the bullet in the plane of parting line 16 outwardly of termination 24 thereof is indicated in FIG. 3 by reference numeral 32. It is preferred that the parting lines all extend an equal distance from the central axis of the bullet and terminate along lines spaced by a distance between about 0.001" and 0.060" from the outer surface of the bullet. This distance remains constant throughout the axial extend of the parting lines, i.e., both within the nose and base portions.

Thus, the bullet of the invention may be characterized as having a plurality of sections, separated by parting lines and the plane perpendicular to the central axis where the parting lines axially terminate, yet remaining integral in that all adjacent sections are joined over at least some areas. The principal distinguishing feature of the invention is that the bullet remains intact, i.e., completely unitary in form, when fired and during flight, until striking and entering a fluidic target such as flesh, organs, or other tissue, and then divides into separate sections which travel in different directions through the target. In the case of the bullet of FIGS. 1–3, the bullet will separate into four totally separate and distinct sections, three of which are the adjacent sections on opposite sides of each of the three parting lines in the portion forward of plane 22, the fourth being the part of base portion 10 rearward of plane 22. The advantages and effect of this characteristic are explained later in detail.

Figure 4:
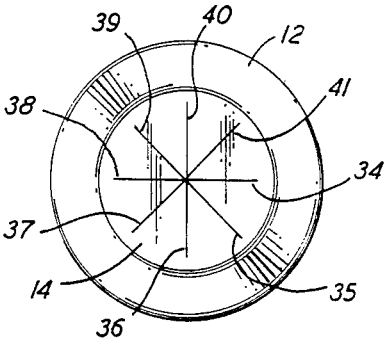
FIG. 4 is an end view, as in FIG. 2, of a second form of the bullet of the invention.

The bullet of FIG. 4 is shown in end view to illustrate that a number of parting lines greater than three may be provided. Since the exterior configuration is the same as that of the bullet of FIGS. 1–3, reference numerals 12 and 14 are again used to denote the tapered nose portion and blunt forward end, respectively. A total of eight parting lines, numbered 34 through 41, extend radially outwardly from the central axis of the bullet, terminating radially a uniform distance from the outer periphery of the bullet and axially in a common plane within base portion 10. The limits of the parting line dimensions and other parameters are the same as in the previously described embodiment. The bullet of FIG. 4 will thus separate into a total of 9 sections, including the part of base portion 10 rearward of plane 22, upon striking a fluidic target.

Figure 6:
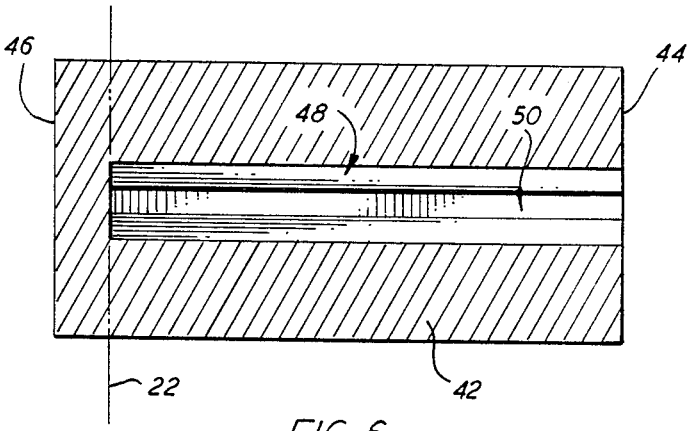
FIG. 6 is a side elevational view in section on the line 6—6 of FIG. 5.
Figure 5:
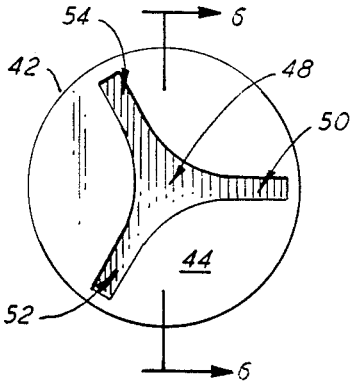
FIG. 5 is an end view of a cylindrical section of metal from which the bullet of the invention is fabricated, showing the appearance thereof after an initial step in the preferred fabrication method.
Figure 7:
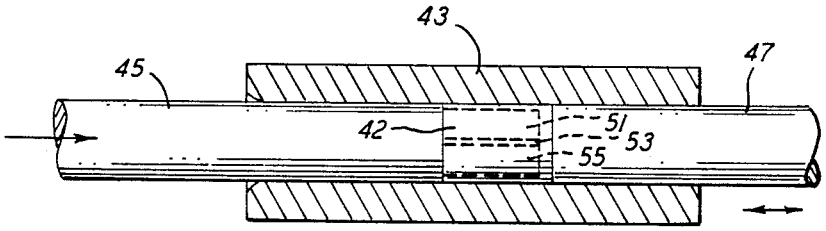
FIGS. 7 and 8 are side elevational views, with portions in section, illustrating preliminary steps in the preferred method of forming the bullet.
Figure 8:
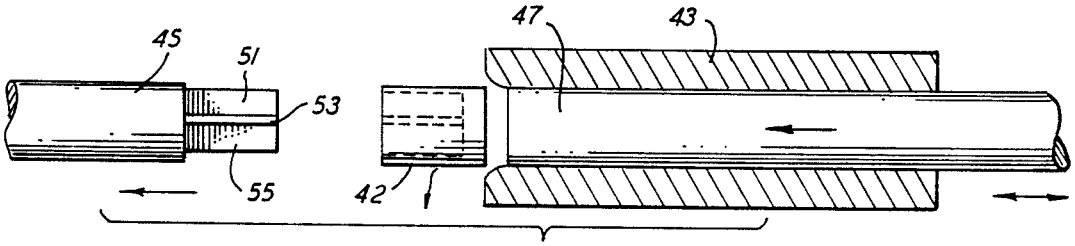

Turning now to FIGS. 5–9, the preferred method of fabrication of the bullet of the invention will be explained in more detail. A cylindrical section 42 of a suitable malleable metal, normally lead or lead alloy, having flat forward and rear ends 44 and 46, respectively, is placed in die 43 and punch 45 is forced axially into the material from forward end 44, being restrained within die 43 by extraction punch 47, as shown in FIG. 7. The punch 45 is moved into the material for a predetermined distance, up to $\frac{7}{8}$ of the axial length of cylindrical section 42, to plane 22, i.e., the plane identified in FIG. 6 as that in which the parting lines within the bullet axially terminate. The punch is then withdrawn, leaving within section 42 a cavity having central portion 48 and three outwardly extending portions 50, 52 and 54, extending radially therefrom and terminating at points uniformly spaced from the outer periphery of section 42, as seen in FIG. 5. Punch 45 includes three essentially planar, radially extending arms 51, 53 and 55 which form the indicated cavity in section 42. As punch 45 is withdrawn, extraction punch 47 is advanced to push section 42 out of die 43, as shown in FIG. 8.

Figure 9:
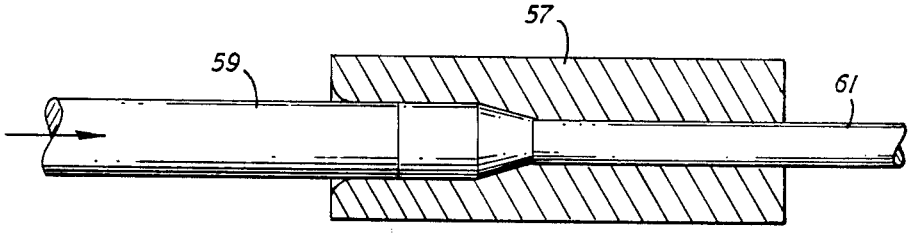
FIGS. 9 and 10 are side elevational views, also having portions in section, showing further steps in the preferred fabrication method.
Figure 10:
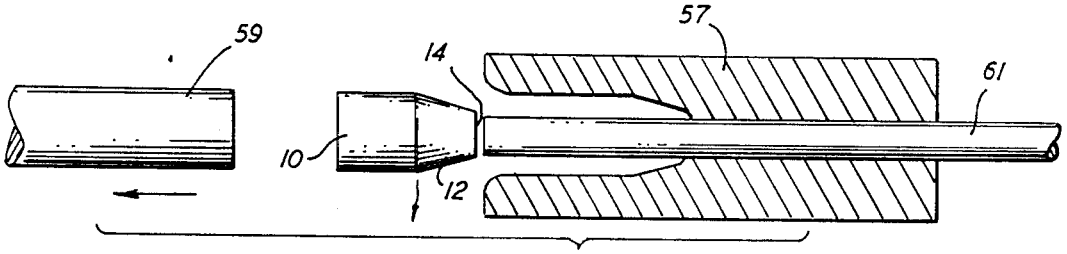

The malleable metal of section 42 is taken compressed radially inwardly in a swaging operation to bring the opposing surfaces of the cavity into intimate contact. That is, essentially all air is eliminated from the cavity, leaving only the previously described parting lines between adjacent faces with the body of section 42. A second die 57 has an internal cavity conforming to the external shape of the finished bullet. Section 42, having internal cavities previously formed by punch 45, is pushed by base or finish punch 59 into die 57 to perform the required compression, as shown in FIG. 9. Punch 59 is then withdrawn and extraction punch 61 is advanced to expel the finished bullet from die 57, as shown in FIG. 10, where the same reference numerals are used on the base 10, nose 12 and end 14 of the bullet as in FIG. 1. In the swaging operation, in addition to compressing the base portion as required to bring opposing surfaces of the cavity into engagement, the forward end is compressed to provide the tapered nose portion 12 with flat or blunt forward end 14 and the bullet assumes the appearance of FIGS. 1 and 2. The bullet formed as shown in FIGS. 5 and 6 will differ internally from that of FIGS. 1–3 in that the plane in which the parting lines axially terminate, i.e., plane 22, is at substantially the minimum distance from the forward end of the bullet in FIGS. 1–3, and at substantially the maximum distance in the bullet formed as in FIGS. 5 and 6. In any case, the swaging operation eliminates the cavity formed by punch 45, expelling essentially all air and bringing opposing surfaces into close engagement.

Figure 11:
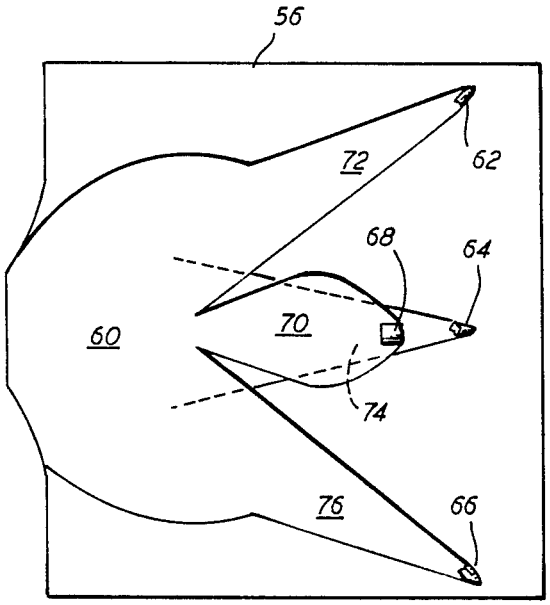
FIG. 11 illustrates the internal appearance of a fluidic target into which a bullet constructed according to the present invention has been fired.
Figure 12:
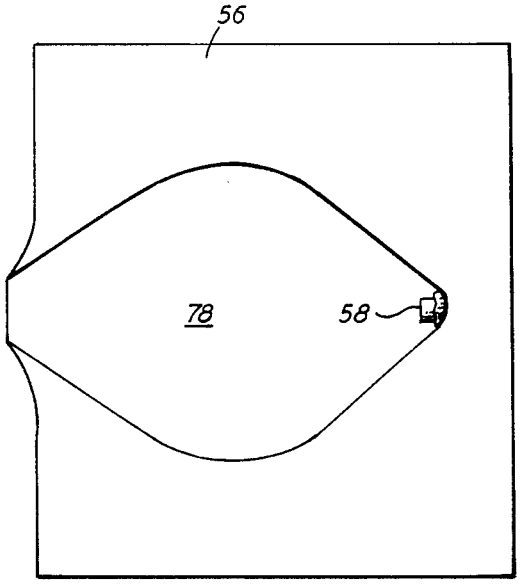
FIG. 12 Prior Art
FIG. 12 illustrates the internal appearance of a fluidic target into which a typical mushrooming or hollow-nosed prior art bullet has been fired.

Referring now to FIGS. 11 and 12, the bullet-target interactions occurring after impact with a fluidic target of the bullet of the present invention and a typical prior art bullet of the mushrooming type are respectively illustrated. Identical blocks 56 of 20% ordnance gelatin, the substance used in standardized tests of this type, were used in actual tests, the results of which are reflected in FIGS. 11–13. The bullet of FIG. 11 was essentially identical to that of FIGS. 1–3 prior to impact. The bullet of FIG. 12, indicated by reference numeral 58, was a typical hollow-point bullet having the same initial weight, diameter and impact velocity as the bullet of FIG. 11.

It should be recognized that FIG. 11 does not represent a two-dimensional cross section of gelatin block 56, but is rather an indication of the three-dimensional travel of the bullet, and individual portions thereof, from the time of entering the block to the final positions of all portions. At the point of impact with the target, the bullet was in one piece, as shown in FIGS. 1–3, creating the large portion 60 of the cavity adjacent the side of impact and penetration. Shortly after entering block 56, the bullet separated into four separate and distinct portions, namely three essentially wedge-shaped portions 62, 64 and 66, and cylindrical portion 68. Portions 62, 64 and 66 are those wedge-shaped portions of the bullet adjacent the previously described parting lines and forward of plane 22, and portion 68 is the part of base portion 10 rearward of plane 22, i.e., the plane of axial termination of parting lines.

After separation from the wedge-shaped portions, portion 68 continues its penetration of the target substantially along the initial axis of travel of the bullet, forming secondary cavity 70, inwardly of cavity 60. Portions 61, 64 and 66 travel separately into the target along paths angled outwardly from the initial axis of bullet travel, forming separate cavities denoted by reference numerals 72, 74 and 76, respectively. From the foregoing explanation, it will be appreciated that in the somewhat diagrammatic representation of FIG. 7, cavities 72 and 76 are closer to the viewer than cavity 60, i.e., closer than the plane of the drawing and angularly disposed with respect thereto. Likewise, cavity 74 is farther from the viewer, i.e., essentially behind cavity 80 in the illustrated orientation.

Bullet 58, on the other hand, remains in a single piece, i.e., in "monoblock" form, after entering the target, and consequently forms but a single cavity 78. The cavities formed by the bullets in both FIGS. 11 and 12, of course, as with any bullet striking and penetrating a fluidic target, are temporary in nature. That is, the fluidic nature of the target causes the cavities to be quickly filled, whereby the illustrations of FIGS. 11 and 12 may be considered in the nature of high-speed photographs.

The size and dispersion of the temporary cavities are, however, an important indication of the incapacitating effect of a bullet on a living target. Furthermore, the cavities shown very generally in FIG. 11 expand to a much larger size within 1½ milliseconds after portions 62, 64, 66 and 68 have come to rest within the target. In the case of a living target, the effect is that tissue and nerves are trapped and compressed between individual, adjacent, expanding cavities, resulting in maximum motor interruption and rapid incapacitation. This, in combination with the wide radial dispersion of portions 62, 64 and 66, greatly increases the chance of striking or otherwise damaging a vital organ in living targets, even when the bullet is poorly placed.

Figure 13:
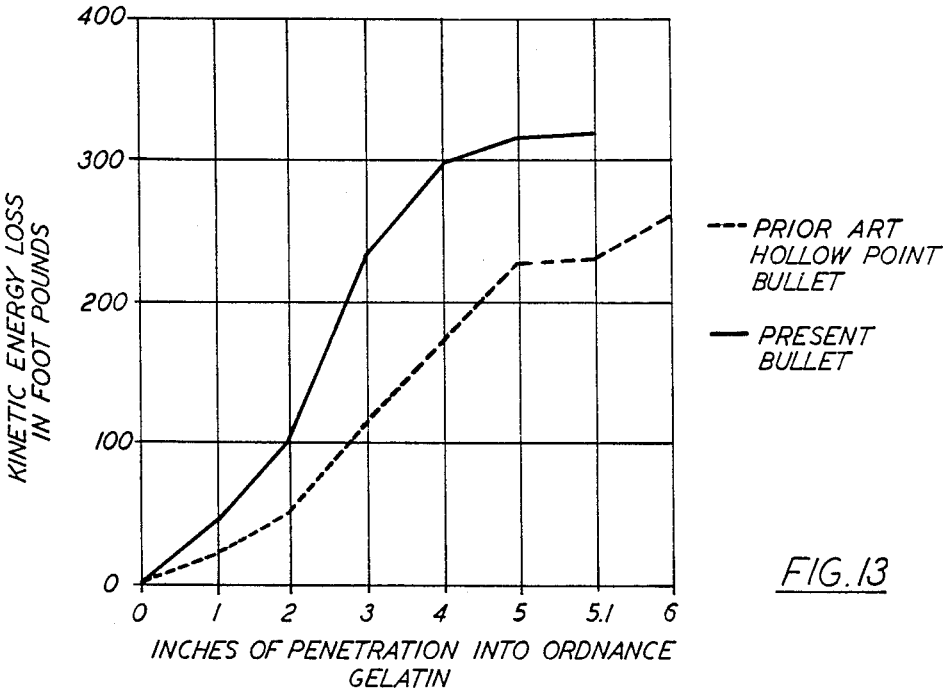
FIG. 13 is a graphical representation of kinetic energy loss versus depth of penetration into a fluidic target of the bullets of FIGS. 11 and 12.

FIG. 13 provides a direct graphical comparison of the cumulative kinetic energy delivered or expended by the bullets of the prior art and the present invention per inch of penetration into a fluidic target.

What is claimed is:

1. A bullet comprising a body of malleable material, symmetrical about a central, longitudinal axis, having an outer periphery defined by a substantially cylindrical base portion extending from the back end of said body for a first portion of the axial length thereof, and a nose portion extending integrally from said base portion for the remainder of the axial length of said boy, to the front end thereof, said nose portion tapering from the diameter of said base portion to a smaller diameter at said front end, and at least three parting lines extending from said front end within said body radially outwardly from, and axially parallel to said central axis, said parting lines defining opposing surfaces terminating radially and axially within said body, the axial terminations lying in a common plane perpendicular to said central axis and within said base portion, the portions of said body on opposite sides of said common plane being integrally joined at said common plane, said opposing surfaces within said body on opposite sides of said parting lines being in mutual contact but physically unattached, said parting lines terminating radially inwardly of said outer periphery of said body a distance sufficient to prevent separation of said body into separate portions during flight, but insufficient to prevent such separation upon impact with a fluidic target, whereby upon impact with such a target said body separates into a plurality of separate portions with those portions laterally adjacent said parting lines separating from one another and from the part of said base portion rearward of said common place to travel separately and create a plurality of impinging pressure zones within said target.

2. The invention according to claim 1 wherein said parting lines terminate radially a constant distance from said outer periphery of said body over the full axial extent of said parting lines.

3. The invention according to claim 2 wherein said constant distance is substantially the same for each of said parting lines.

4. The invention according to claim 3 wherein said constant distance is between about 0.001" and 0.060".

5. The invention according to claim 3 wherein said parting lines are disposed at equal angles from one another about said central axis.

6. The invention according to any of claims 1 through 5 wherein said front end is blunt.

7. The invention according to claim 1 wherein said common plane is positioned within said base portion a distance from said back end equal to at least ⅛ of the total axial length of said body.

8. The invention according to claim 7 wherein said base portion extends from said back end for at least ½ of the total axial length of said body portion.

9. The invention according to claim 8 wherein said front end is substantially flat, lying in a plane perpendicular to said central axis.

10. The invention according to claim 8 wherein said parting lines terminate a substantially constant distance from said outer periphery of said body throughout their axial lengths.

* * * * *